US008317639B1

(12) United States Patent
McVan

(10) Patent No.: US 8,317,639 B1
(45) Date of Patent: Nov. 27, 2012

(54) SOCCER TRAINING DEVICE

(75) Inventor: Michael McVan, Wellington, FL (US)

(73) Assignee: Perfect Pecs LLC, Wellington, FL (US)

( * ) Notice: Subject to any disclaimer, the term of this patent is extended or adjusted under 35 U.S.C. 154(b) by 0 days.

(21) Appl. No.: 13/099,847

(22) Filed: May 3, 2011

(51) Int. Cl.
*A63B 69/00* (2006.01)
*A41D 13/06* (2006.01)

(52) U.S. Cl. ..... 473/450; 473/424; 473/426; 2/22

(58) Field of Classification Search ..... 473/422, 473/446, 450, 458, 464, 423, 424, 426, 576, 473/510, 518, 430; 482/88, 129, 142; 36/133, 36/139; 2/22, 24
See application file for complete search history.

(56) References Cited

U.S. PATENT DOCUMENTS 3,140,871 A * 7/1964 Liquori ..... 473/576
3,165,315 A * 1/1965 Petrusek ..... 36/139
4,021,035 A 5/1977 O'Hara
4,042,241 A * 8/1977 Collins ..... 473/424
4,071,241 A * 1/1978 Cortes Garcia ..... 473/424
4,121,822 A * 10/1978 DiSabatino et al. ..... 482/88
4,145,046 A * 3/1979 Jones ..... 473/424
4,325,548 A * 4/1982 Piccini ..... 482/129
4,333,658 A * 6/1982 Giovetti ..... 473/424
4,564,196 A * 1/1986 Carbonetti ..... 473/518
4,674,157 A * 6/1987 Litz ..... 2/22
4,687,209 A * 8/1987 Carey ..... 473/424
4,718,676 A * 1/1988 Collins, Jr. ..... 473/510
5,094,462 A * 3/1992 Boyle et al. ..... 473/576
5,244,206 A * 9/1993 Clark et al. ..... 273/DIG. 19
5,669,837 A * 9/1997 Hauter ..... 473/576
5,782,727 A * 7/1998 Pierce ..... 482/129
5,926,844 A * 7/1999 Bear ..... 2/22
5,980,405 A * 11/1999 Hertel ..... 473/576
6,802,788 B1 * 10/2004 Moushi et al. ..... 473/426
2011/0016597 A1 * 1/2011 Nascimento et al. ..... 2/22

* cited by examiner

*Primary Examiner* — Mitra Aryanpour
(74) *Attorney, Agent, or Firm* — Robert M. Downey, P.A.

(57) ABSTRACT

A soccer training device includes a pair of leg components to be worn on a user's legs, each having a shin guard kneepad and foot cover member. An assortment of recessed attachment portals are included on shin guards, kneepads, and foot covers for releasably securing opposite ends of an elastomeric cord, which has a training ball secured along its length, producing two legs of the elastomeric cord, each being selectively secured to a respective leg component. In operation, the user begins alternating movement of his or her legs, thereby causing the ball to alternatively strike the selected areas and travel away from the user until the elastomeric cord stretches taut and causes the ball to travel back towards the user for striking with the opposite leg. The user continues kicking the ball from one leg to the other as many times as he or she can consecutively hit the ball.

14 Claims, 9 Drawing Sheets

SOCCER TRAINING DEVICE

BACKGROUND OF THE INVENTION

1. Field of the Invention

The present invention relates to soccer and, more particularly, a soccer training device that includes a soccer ball that may be releasably connected to an elastomeric cord having opposite ends, each of which may be releasably secured to one of an assortment of recessed attachment portals located on the device's leg members, which include shin guards, kneepads and foot covers, wherein appropriate lower body movement causes the soccer ball to alternatively strike the selected areas on each of the user's legs.

2. Discussion of the Related Art

While a large number of exercise devices which have no association with a particular sport or activity are provided for general fitness, relatively few training devices are used by children and adults for improving their athletic skill in a particular sporting activity. Certain sporting activities can be more readily captured in the form of a workable training device than others. For example, there are various football training devices that assist its user in appropriately holding and throwing a football. Likewise, there are various golf training devices that assist its user in appropriate golf swing technique.

Soccer is one of the most popular sports in the United States, especially amongst young children, and is widely considered to be the most popular sporting activity globally. Soccer requires a combination of physical endurance and a high degree of skill. While several attempts have been directed towards soccer training devices, a large majority of these devices have generally required an elaborate setup consisting of a soccer net (i.e. soccer goal), such as the training devices disclosed by Pakieser (U.S. Pat. No. 7,037,219) and Szwalek (U.S. Pat. No. 6,846,253). Therefore, there is a particular need for a useful soccer training device that is fun and easy to use, which also helps to perfect lower body and eye coordination.

OBJECTS AND ADVANTAGES OF THE INVENTION

Considering the foregoing, it is a primary object of the present invention to provide a training device that is particularly related to the sport of soccer and which provides an excellent cardiovascular workout.

It is a further object of the present invention to provide a soccer training device that allows for alternating use of both legs and both feet, in a right to left to right transfer action, thereby providing a balanced training exercise that does not favor a dominant leg.

It is a further object of the present invention to provide a soccer training device that helps to perfect lower body and eye coordination of the user.

It is still a further object of the present invention to provide a soccer training device that requires skill and that invites competition among multiple users during a training session.

It is still a further object of the present invention to provide a soccer training device that provides a lower body workout.

It is yet a further object of the present invention to provide a soccer training device that uses a soccer ball attached at a point along an elastomeric cord, each of the ends of the elastomeric cord being releasably secured to one's opposing legs at one of an assortment of recessed attachment portals located on the device's shin guards, kneepads, and foot covers.

It is still a further object of the present invention to provide a soccer training device that is relatively inexpensive and easy to use, thereby enhancing the marketability of the invention to both advanced and novice soccer players of all ages.

These and other objects and advantages of the present invention are readily apparent with reference to the detailed description and accompanying drawings.

SUMMARY OF THE INVENTION

The present invention is directed to a soccer training device that includes a pair of leg components, each having a shin guard member, a kneepad member, and a foot cover member to be worn on both of a user's legs. An assortment of recessed attachment portals are included on the outer facing side of the shin guards, kneepads, and foot covers for releasably securing opposite ends of an elastomeric cord, which has a training ball secured along its length, producing two legs of the elastomeric cord. In operation, the user selectively attaches each of the ends of the elastomeric cord to a recessed attachment portal on opposite leg components and begins alternating movement of his or her legs. This action causes the ball to alternatively strike the selected areas and travel away from the user until the elastomeric cord leading from the opposite leg stretches taut and causes the ball to travel back towards the user, in a reciprocating action, for striking with the opposite leg. The user continues the alternating movement, kicking the ball from one leg to the other as many times as he or she can consecutively hit the ball. In an alternate embodiment, a belt member having an elastomeric cord in communication with the training ball is used, which facilitates use of the device when training with the upper portion of the lower body. In yet another embodiment, the foot covers may be manufactured as an integral part of a shoe, or may be releasably attached to the top side of a shoe. The length of the cord legs may be varied in accordance with a desired training drill. For example, a longer length of the cord legs allows the ball to strike the upper thighs, stomach, and possibly the chest.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Figure 1:
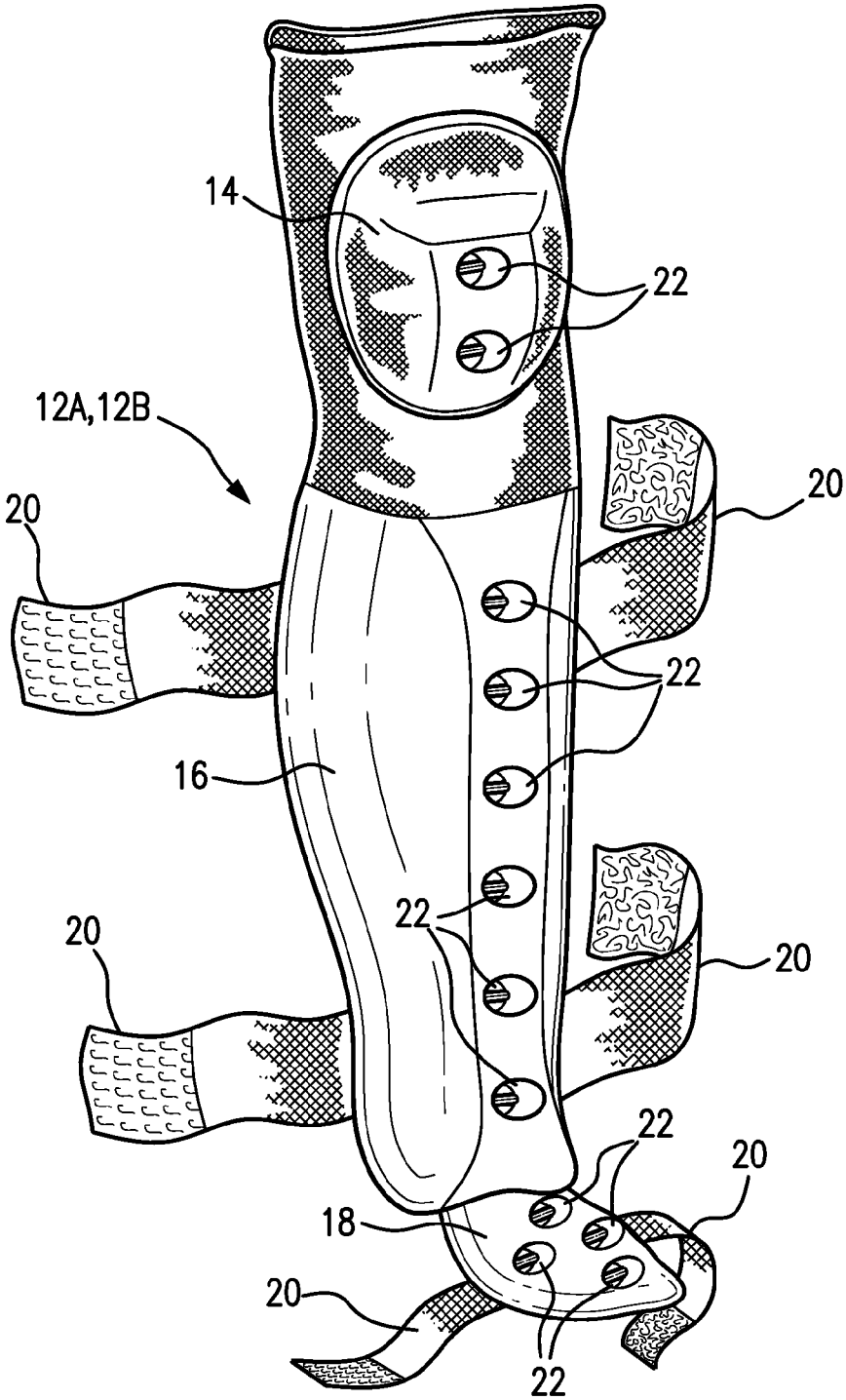
FIG. 1 is a front perspective view of the soccer training device of the present invention showing a leg component and including an assortment of recessed attachment portals located on a kneepad members, a shin guard member and a foot cover member.

Referring to the several views of the drawings, and initially FIGS. 1-5, the soccer training device is shown and is generally indicated as 10.

The soccer training device 10 includes two leg components (12A and 12B) adapted to be worn on either leg of the user. In each of the embodiments of the invention, each of the leg components (12A and 12B) is comprised of a kneepad member 14, a shin guard member 16, and a foot cover member 18. Straps 20 are provided for securing the leg component (12A and 12B) to the user's leg. An assortment of recessed attachment portals 22 are located on each kneepad member 14, shin guard member 16 and foot cover member 18, and are sized to receive and releasably secure one end (32 and 36) of an elastomeric cord. Alternatively, the foot cover member 18 may be made available separately from the leg component (12A or 12B), wherein the foot cover member 18 is attachable to the top side of a shoe, or permanently affixed, such as by stitching, to the top side of the shoe.

Figure 2:
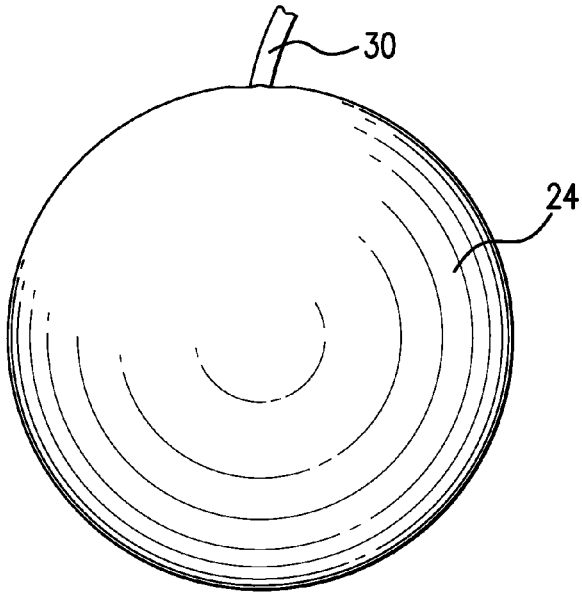
FIG. 2 is a perspective view of the soccer ball, illustrating an elastomeric cord extending outwards from the ball.

A training ball 24, as illustrated in FIG. 2, has approximately the same weight and size characteristics as a regulation soccer ball. In at least one embodiment, a tether ball is suitable for this purpose. Users in particular age groups that utilize soccer balls having non-regulation weight and size characteristics may use a training ball 24 that more accurately meets their needs. The training ball 24 includes a recessed training ball attachment portal 26 that utilizes a bar attachment mechanism 28 for attachment of an elastomeric cord 30. In this embodiment, the elastomeric cord 30 is tied in a knot around the bar attachment mechanism 28, effectively securing the training ball 24 to the elastomeric cord 30. Other attachment mechanisms within the recessed training ball attachment portal 26 may be used to achieve the same results.

Figure 3:
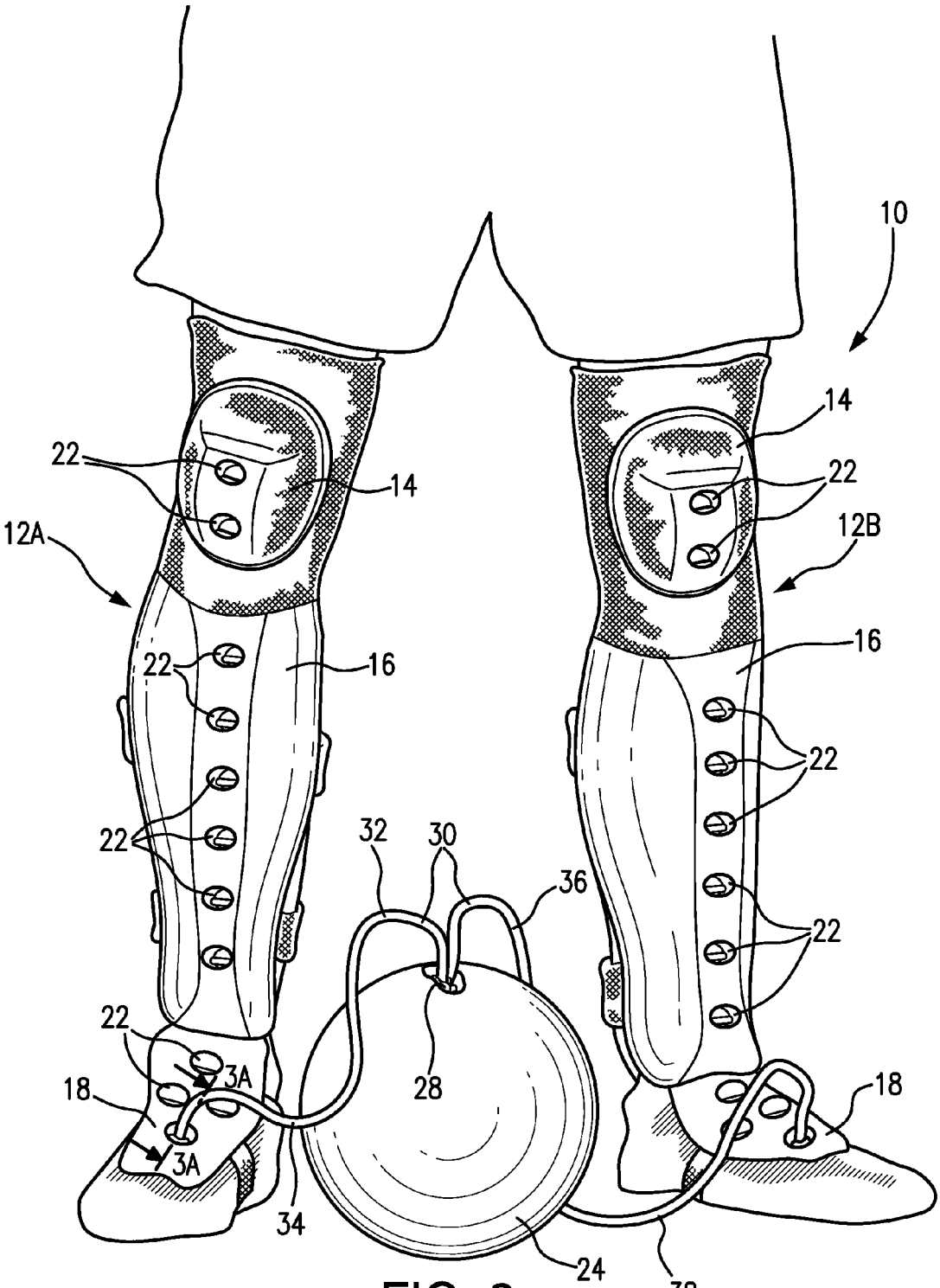
FIG. 3 is a front perspective view of the soccer training device of the present invention, in accordance with a preferred embodiment, wherein the ends of the elastomeric cord have been releasably secured to the foot covers of the user's opposing leg members.
Figure 4:
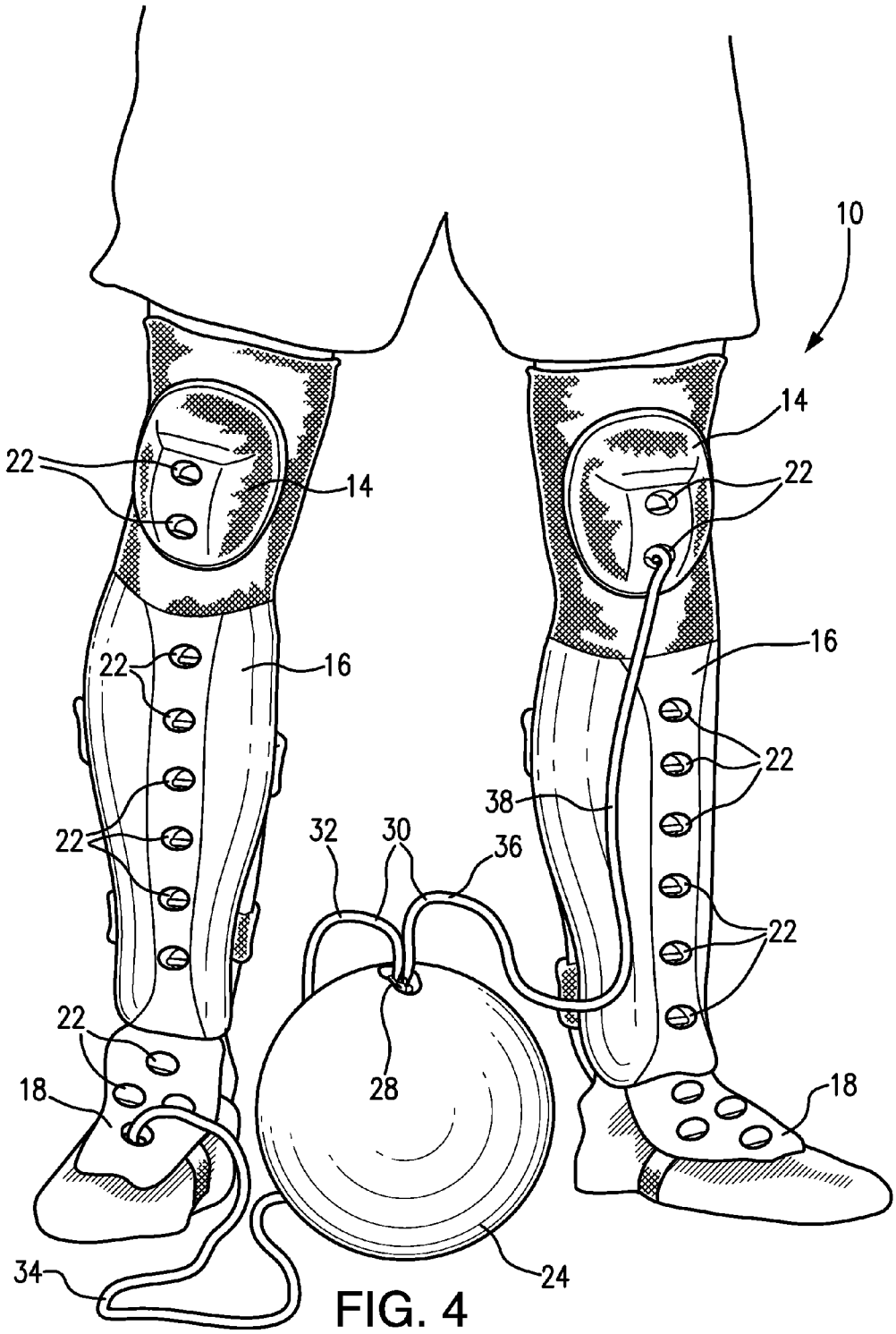
FIG. 4 is a front perspective view of the soccer training device of the present invention, in accordance with a preferred embodiment, wherein one end of the elastomeric cord has been releasably secured to the kneepad on the user's left leg member and the opposing end of the elastomeric cord has been releasably secured to the foot cover on the user's right leg member.
Figure 5:
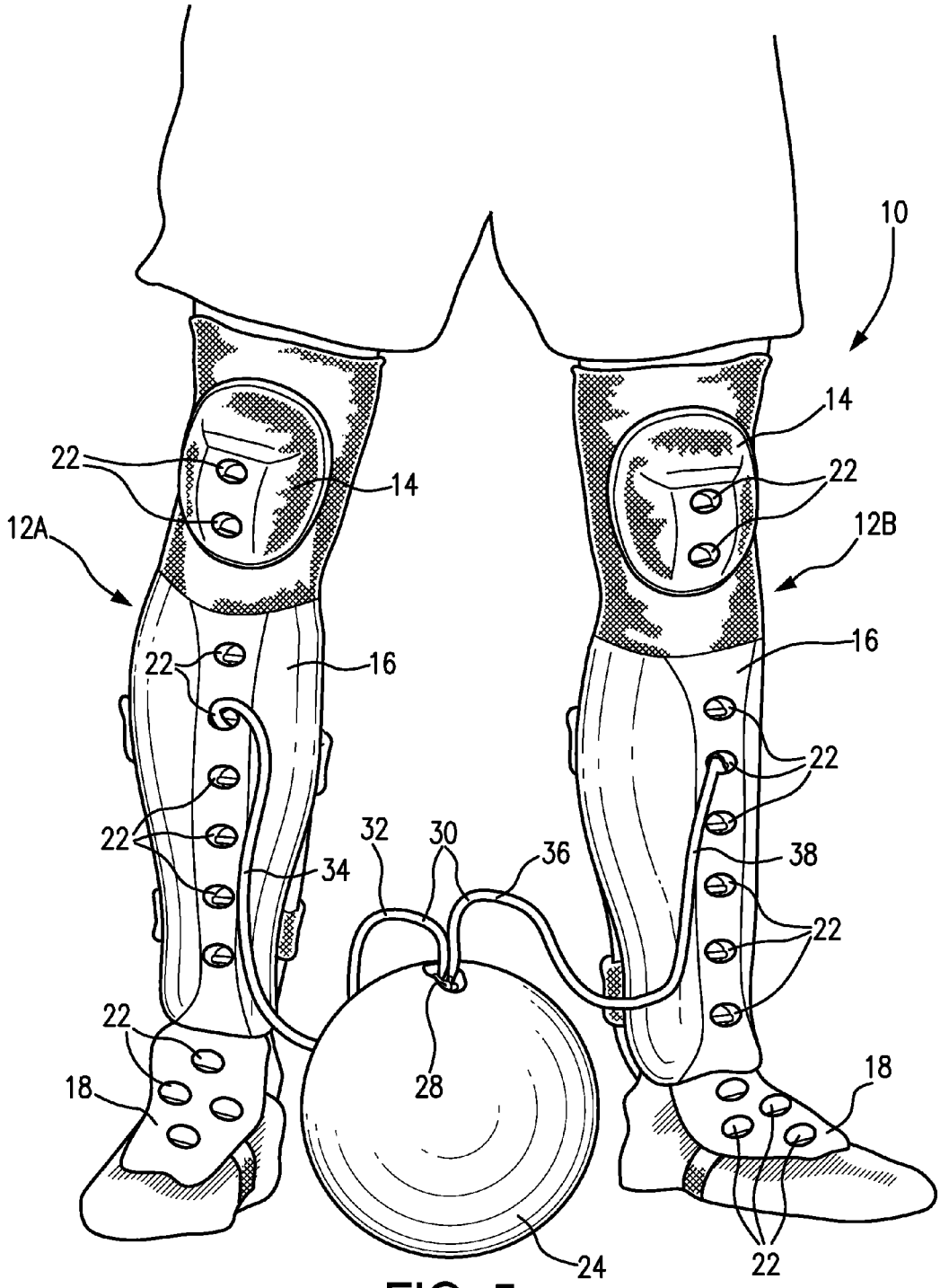
FIG. 5 is a front perspective view of the soccer training device of the present invention, in accordance with a preferred embodiment, wherein the ends of the elastomeric cord have been releasably secured to the shin guards of the user's opposing leg members.

FIGS. 3-5 illustrate different preferred embodiments of the soccer training device. In each of the embodiments, a first end 32 of the elastomeric cord 30 exits from the training ball 24 and is releasably secured in a recessed attachment portal 22 located on the first leg component 12A, forming a first leg 34 of the elastomeric cord 30. A second end 36 of the elastomeric cord 30 exits from the training ball 24 and is releasably secured in a recessed attachment portal 22 located on the second leg component 12B, form a second leg 38 of the elastomeric cord.

Figure 6:
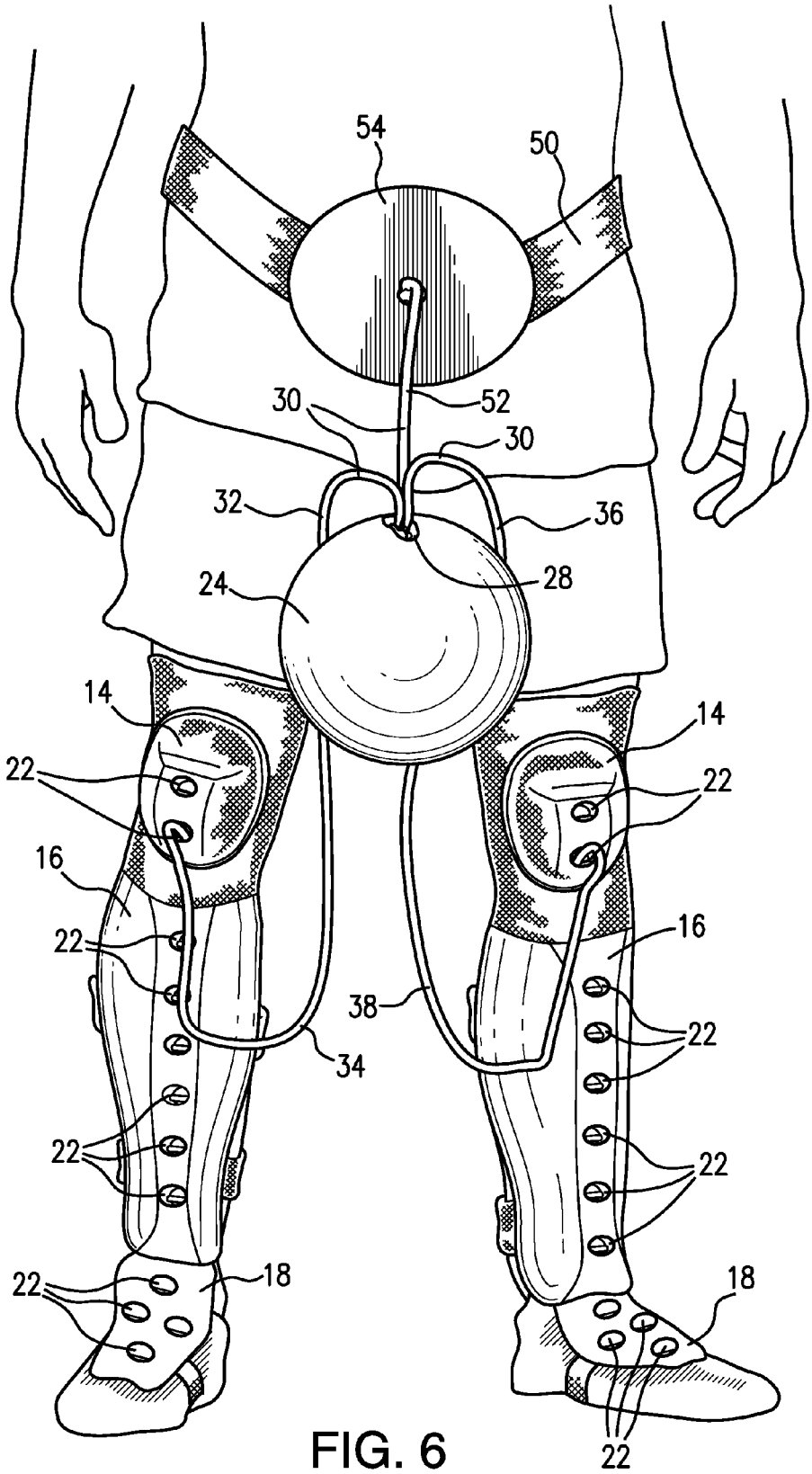
FIG. 6 is a front perspective view of the soccer training device of the present invention, in accordance with a preferred embodiment, wherein a belt member having an elastomeric cord that is releasably secured to the soccer ball is included, and the ends of the elastomeric cord have been releasably secured to the kneepads of the user's opposing leg members.

An alternative embodiment is illustrated in FIG. 6, wherein a belt member 50 is worn by the user. The belt member 50 includes a second elastomeric cord 52 extending from a buckle 54. The opposite end of the second elastomeric cord 52 is tied to the bar attachment mechanism 28 within the recessed training ball attachment portal 26.

Figure 2A:
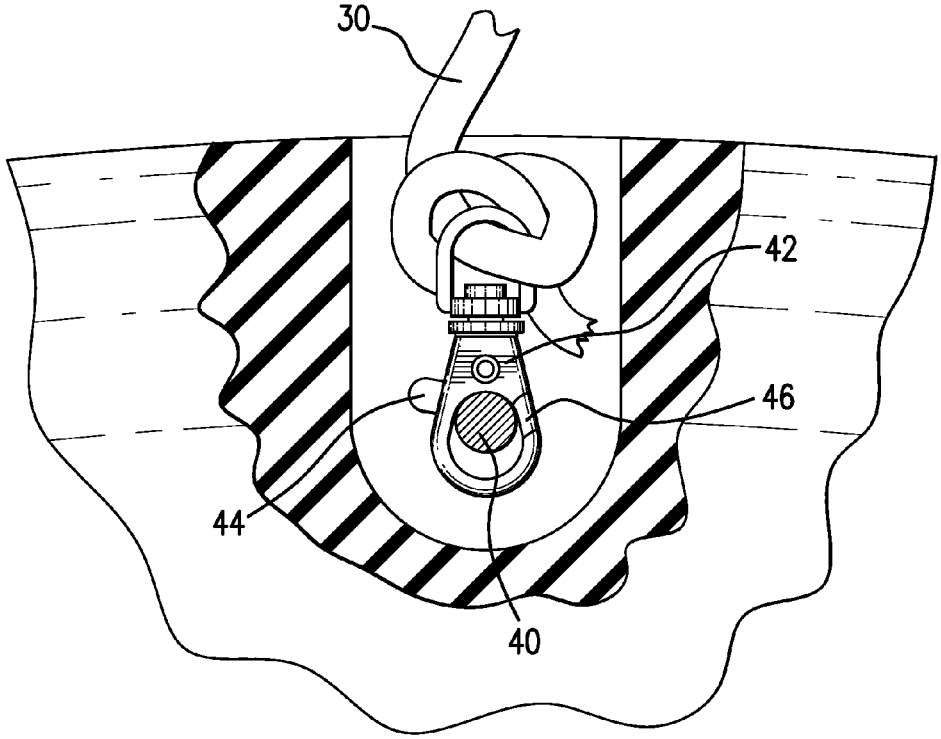
FIG. 2A is an isolated cross sectional view showing connection of the elastomeric cord to the soccer ball in FIG. 2.

In each of the embodiments, an attachment bar 40 is used to releasably secure the ends (32 and 36) of the elastomeric cord within the recessed attachment portals 22. As illustrated in FIG. 2A, one of the ends (32 and 36) of the elastomeric cord 30 is tied to the distal end of a clasp 42, which includes a clasp switch 44 for opening and closing the clasp member 46. The clasp 42 is sized to grasp the attachment bar 40 when the clasp switch 44 is engaged by the user, thereby opening the clasp member 46. The clasp switch 44 is then released, which closes the clasp member 46, thereby releasably securing the clasp 42 to the attachment bar 40. While this embodiment of the present invention utilizes the clasp-attachment bar combination, any other suitable method of attaching the elastomeric cord within the recessed attachment portal 22, such as a spring-loaded push and twist locking mechanism, may be used as well.

As illustrated in FIGS. 3-6, the user, wearing the two leg components (12A and 12B), selectively attaches the first end 32 and the second end 36 of the elastomeric cord 30 to an attachment portal 22 located on the first leg component 12A and second leg component 12B, respectively. As an assortment of attachment portals 22 are located on each of the kneepad, shin guard and foot cover components, a variety of different training combinations are available to the user, each of which allow the user to train a particular area of skill. FIG. 6 illustrates the preferred embodiment of the soccer training device 10 when the belt member 50 is used.

Figure 7:
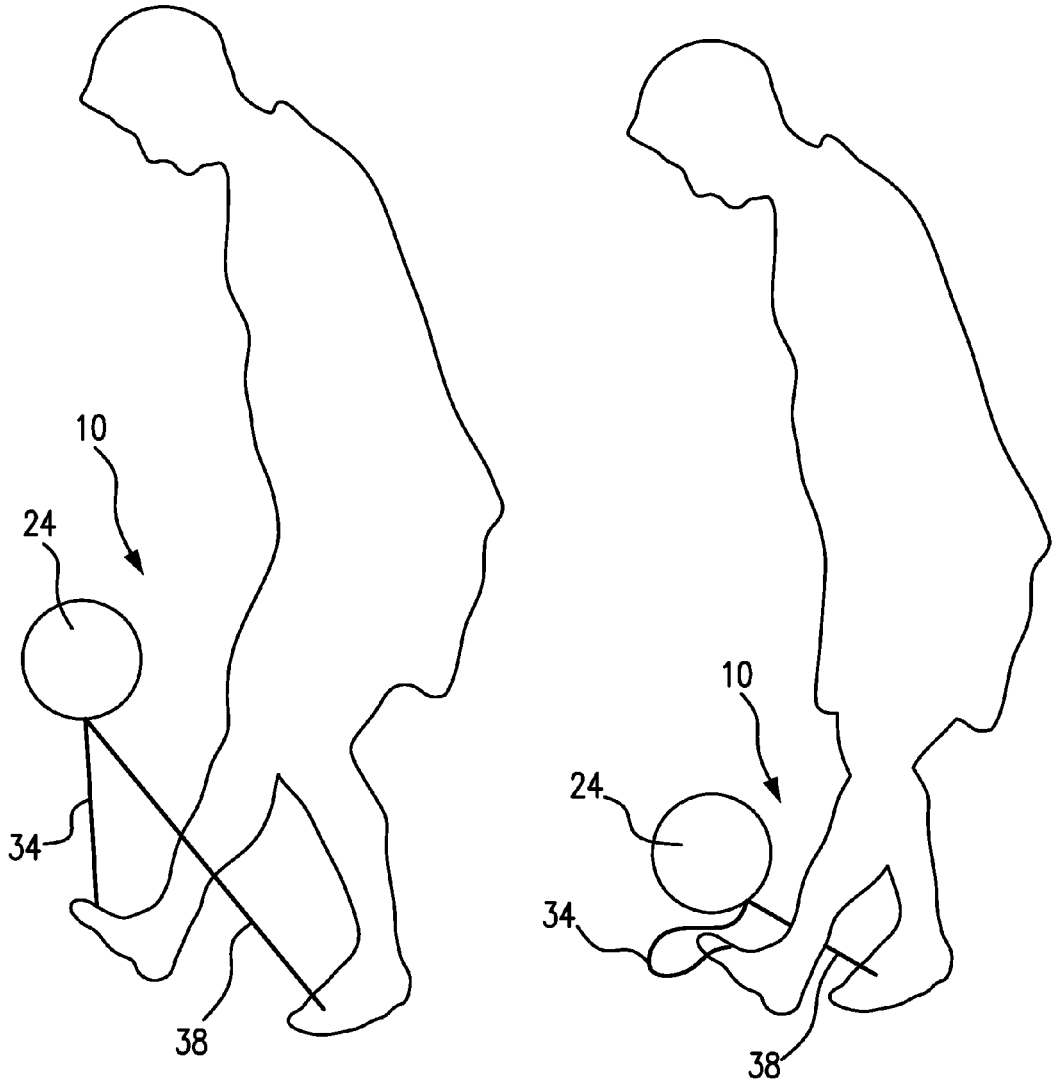
FIGS. 7-8 present perspective views of a person using the soccer training device of FIGS. 3-5 and illustrate a sequence of operation wherein the person using the soccer training device moves his or her legs in alternating fashion which causes the soccer ball to alternatively strike the opposing leg members, as the soccer ball moves away from the user and then comes back toward the user in a reciprocating action after each strike of the soccer ball.
Figure 8:
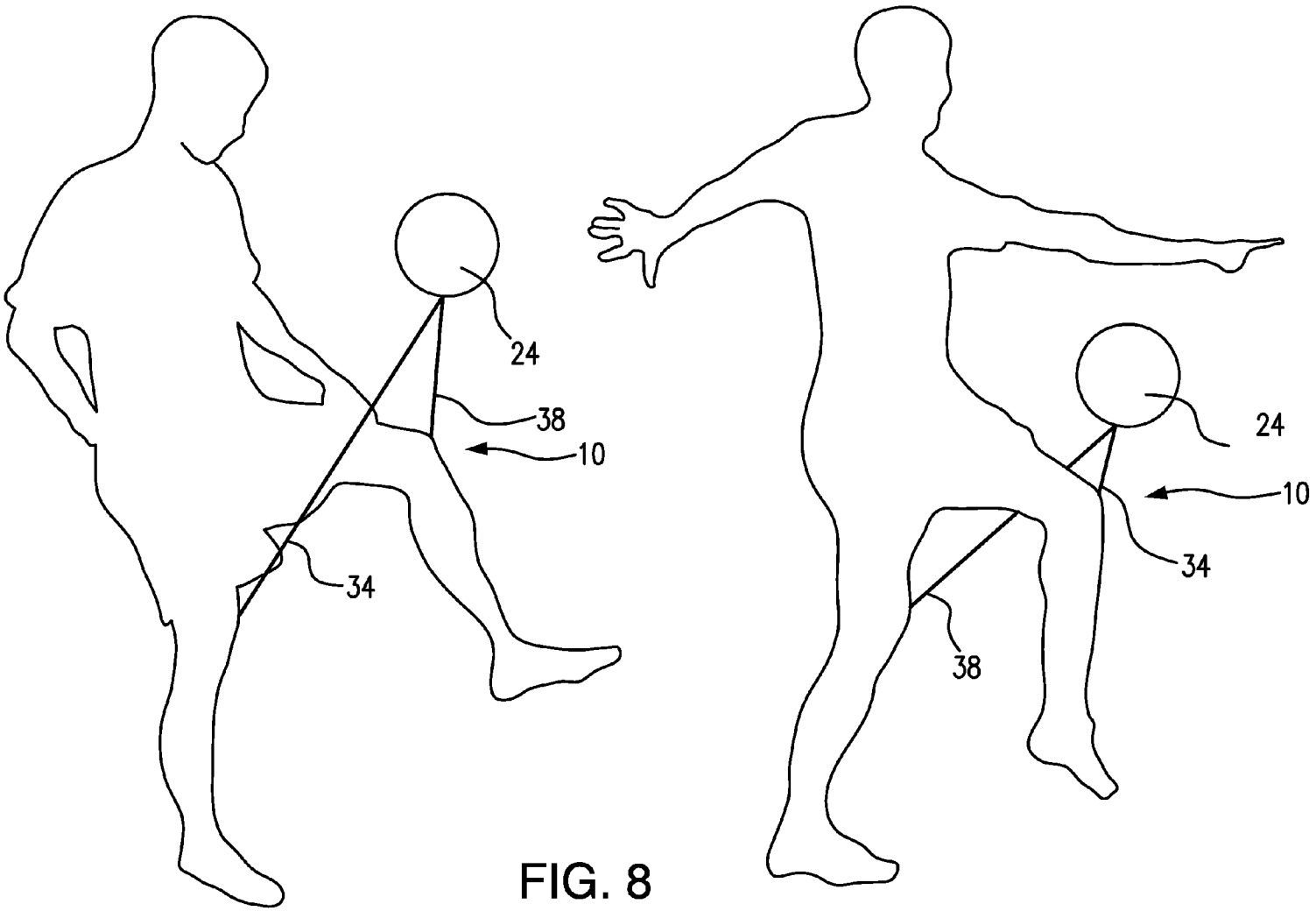
Figure 9:
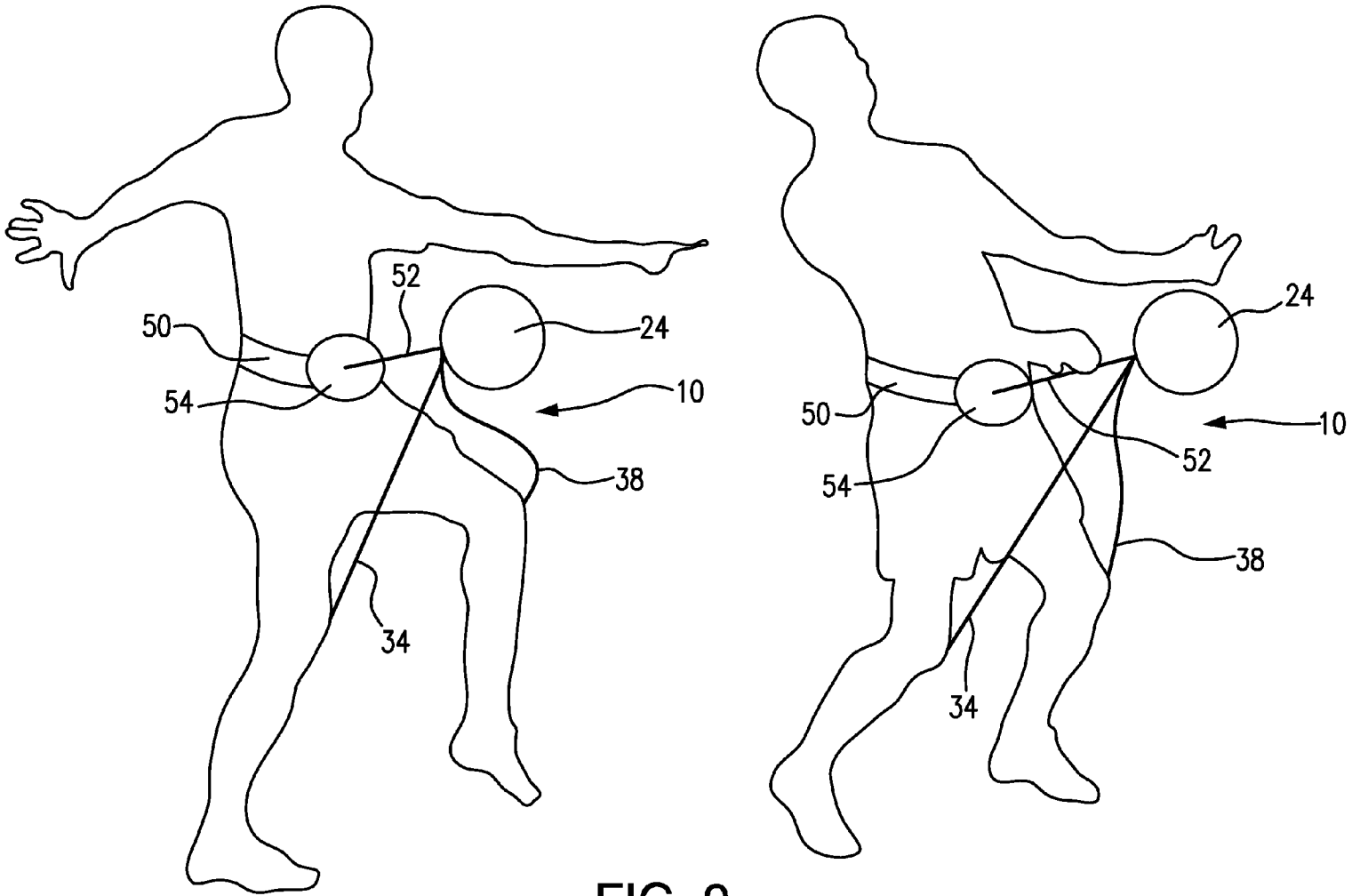
FIG. 9 presents perspective views of a person using the soccer training device of FIG. 6 and illustrates a sequence of operation wherein the person using the soccer training device utilizes his or her mid section in addition to moving his or her legs in alternating fashion which causes the soccer ball to alternatively strike the kneepad components of the user's opposing leg members.

FIGS. 7-9 illustrate the manner of use of the soccer training device 10 of the present invention. As seen, a user wearing the two leg components (12A and 12B) begins lightly tapping the training ball 24 with the selected area before striking the ball 24, causing the training ball 24 to travel outwardly away from the user. As the ball 24 travels away from the user, the leg (34 or 38) of the elastomeric cord 30 connecting between the training ball 24 and the region of the selected attachment portal 22 that struck the ball 24 stretches and becomes taut. The energy in the stretched elastomeric cord slows the ball in its direction away from the user and then urges the ball back towards the user, in the opposite direction. As the training ball 24 returns towards the user, the user strikes the ball 24 with the opposite leg component (12A or 12B), again causing the ball 24 to hit the region of the selected attachment portal 22 and bounce away from the user. The respective leg (34 or 38) of the elastomeric cord 30 will again stretch and eventually pull the ball 24 back toward the user for a subsequent strike with the opposite leg component (12A or 12B). The user continues striking the ball 24 in alternating fashion, causing the ball 24 to travel away from the user until the elastomeric cord 30 stretches taut and causes the ball 24 to travel back towards the user, in a reciprocating action, for striking with the opposite leg component (12A or 12B). The user continues kicking the ball from one leg to the other as many times as he or she can consecutively hit the ball 24. Several users of the soccer training device 10 may compete as they each try to achieve the highest number of consecutive hits of the ball 24. In the alternative embodiment illustrated in FIG. 9, the belt member 50 maintains the ball 24 at a height sufficient to train the user's ability to kick the ball from one kneepad member 14 to the other.

In addition to its soccer training features, the action of using the device 10, as described above, provides an excellent cardiovascular workout, and particularly strengthening and toning the user's lower body.

While the present invention has been shown and described in accordance with several preferred and practical embodiments thereof, it is recognized that departures from the instant disclosure are fully contemplated within the spirit and scope of the invention as defined in the following claims and as interpreted under the Doctrine of Equivalence.

What is claimed is:

1. A soccer training device comprising:

a first leg component adapted to be worn on a first leg of a user and a second leg component adapted to be worn on a second leg of a user;

said first and second leg components each including a kneepad member, a shin guard member, and a foot cover member;

a plurality of recessed attachment portals on said kneepad member, said shin guard member, and said foot cover member;

a resilient ball possessing bouncing characteristics and said resilient ball having a recessed attachment mechanism;

a first leg of an elastomeric cord extending between and releasably connecting to one of said plurality of recessed attachment portals on said first leg component and said recessed attachment mechanism on said resilient ball, and a second leg of an elastomeric cord extending between and releasably connecting to one of said plurality of recessed attachment portals on said second leg component and said recessed attachment mechanism on said resilient ball, and said first leg and said second leg of the elastomeric cord each being of equal length; and whereby the user, while wearing said first leg component and said second leg component, extends left and right kicks, in alternating sequence, causing said resilient ball to strike one of said first and second leg components and then bounce in a direction away from the user until one of said first and second legs of the elastomeric cord is stretched taut and urges the ball back towards the user as the user extends a kick with the opposite leg component to cause the ball to strike the other of said first and second legs members in an alternating sequence.

2. The soccer training device as recited in claim 1 wherein said first and second leg components include straps for releasably securing said first and second leg components to the user's respective legs.

3. The soccer training device as recited in claim 1 wherein said first leg and said second leg of said elastomeric cord are independent of one another.

4. The soccer training device as recited in claim 1 wherein said first and second legs of said elastomeric cord are sections of a continuous length of the elastomeric cord releasably attached to both said first and second leg components and said resilient ball.

5. The soccer training device as recited in claim 1 wherein the proximal end of said first and second legs of the elastomeric cord includes a clasp and each of said plurality of recessed attachment portals includes an attachment bar, and whereby said clasp is structured and disposed for insertion within said recessed attachment portal and releasably securing to said attachment bar.

6. The soccer training device as recited in claim 1 wherein the proximal end of said first and second leg of the elastomeric cord includes a locking member and each of said plurality of recessed attachment portals includes and spring-loaded attachment mechanism, and whereby said locking member is structured and disposed for insertion within said recessed attachment portal and engaging said spring-loaded attachment mechanism, after which said locking member is rotated approximately 90 degrees for locked attachment.

7. The soccer training device as recited in claim 1 wherein said recessed attachment mechanism on said resilient ball is a recessed bar, said recessed bar being structured and disposed for securing the distal end of said first and second legs of said elastomeric cord, and whereby the distal end of said first and second legs of said elastomeric cord are tied to said recessed bar.

8. A soccer training device comprising:

a first and second foot cover member adapted to be worn on the top side of a user's shoe;

a plurality of recessed attachment portals on said foot cover member;

a resilient ball possessing bouncing characteristics and said resilient ball having a recessed attachment mechanism;

a first leg of an elastomeric cord extending between and releasably connecting to one of said plurality of recessed attachment portals on said first foot cover and said recessed attachment mechanism on said resilient ball, and a second leg of an elastomeric cord extending between and releasably connecting to one of said plurality of recessed attachment portals on said second foot cover and said recessed attachment mechanism on said resilient ball, and said first leg and said second leg of the elastomeric cord each being of equal length; and whereby the user, while wearing said first foot cover and said second foot cover, extends left and right kicks, in alternating sequence, causing said resilient ball to strike one of said first and second leg foot covers and then bounce in a direction away from the user until one of said first and second legs of the elastomeric cord is stretched taut and urges the ball back towards the user as the user extends a kick with the opposite foot cover to cause the ball to strike the other of said first and second foot covers in an alternating sequence.

9. The soccer training device as recited in claim 8 wherein said first and second foot covers are manufactured as an integral part of a shoe.

10. The soccer training device as recited in claim 8 wherein said first leg and said second leg of said elastomeric cord are independent of one another.

11. The soccer training device as recited in claim 8 wherein said first and second legs of said elastomeric cord are sections of a continuous length of the elastomeric cord releasably attached to both said first and second foot covers and said resilient ball.

12. The soccer training device as recited in claim 8 wherein the proximal end of said first and second legs of the elastomeric cord includes a clasp and each of said plurality of recessed attachment portals includes an attachment bar, and whereby said clasp is structured and disposed for insertion within said recessed attachment portal and releasably securing to said attachment bar.

13. The soccer training device as recited in claim 8 wherein the proximal end of said first and second leg of the elastomeric cord includes a locking member and each of said plurality of recessed attachment portals includes and spring-loaded attachment mechanism, and whereby said locking member is structured and disposed for insertion within said recessed attachment portal and engaging said spring-loaded attachment mechanism, after which said locking member is rotated approximately 90 degrees for locked attachment.

14. The soccer training device as recited in claim 8 wherein said recessed attachment mechanism on said resilient ball is a recessed bar, said recessed bar being structured and disposed for securing the distal end of said first and second legs of said elastomeric cord, and whereby the distal end of said first and second legs of said elastomeric cord are tied to said recessed bar.

* * * * *